United States Patent [19]

Tumber

[11] 4,393,826

[45] Jul. 19, 1983

[54] LIQUID FUEL INJECTION PUMPING APPARATUS

[75] Inventor: Brian W. Tumber, Greenford, England

[73] Assignee: Lucas Industries Limited, Birmingham, England

[21] Appl. No.: 310,992

[22] Filed: Oct. 13, 1981

[30] Foreign Application Priority Data

Dec. 23, 1980 [GB] United Kingdom ..... 8041282

[51] Int. Cl.[3] ..... F02D 17/00; F02D 1/06

[52] U.S. Cl. ..... 123/198 DB; 123/446; 123/387; 123/479; 417/462; 417/206

[58] Field of Search ..... 123/387, 198 D, 198 DB, 123/479, 446, 385, 462; 417/253, 206, 462

[56] References Cited

U.S. PATENT DOCUMENTS

| | | | |
|---|---|---|---|
| 2,999,463 | 9/1961 | Cameron-Johnson | 417/253 |
| 3,263,614 | 8/1960 | Kemp | 417/206 |
| 3,289,590 | 12/1966 | Hutcheon | 417/253 |
| 3,485,225 | 12/1969 | Bailey | 123/387 |
| 3,592,176 | 7/1971 | Fenne | 417/462 |
| 3,663,123 | 5/1972 | Fenne | 417/462 |
| 4,291,532 | 9/1981 | Robinson | 123/198 D |
| 4,327,684 | 5/1982 | Sami | 123/387 |

*Primary Examiner*—Charles J. Myhre
*Assistant Examiner*—Carl Stuart Miller

[57] ABSTRACT

A liquid fuel injection pumping apparatus of the axially slidable rotor type includes a low pressure supply pump which supplies fuel to an injection pump including pumping plungers mounted in a rotary distributor member. A surface of the distributor member is located within a chamber to which a control pressure can be supplied by way of a control valve from the outlet of the low pressure pump. The distributor member is moved by increasing control pressure against a spring to reduce the amount of fuel supplied by the injection pump. A valve is provided which is responsive to the pressure drop across the control valve, the valve acting to prevent flow of fuel to the injection pump in the event that the pressure drop across the control valve falls below a predetermined value.

4 Claims, 2 Drawing Figures

LIQUID FUEL INJECTION PUMPING APPARATUS

This invention relates to liquid fuel injection pumping apparatus for supplying fuel to an internal combustion engine and of the kind comprising an injection pump operable in use to deliver fuel in timed relationship with an associated engine, a low pressure supply pump for supplying fuel to the injection pump, valve means for controlling the output pressure of the supply pump, a resiliently loaded component defining a surface against which a control pressure can act to enable the amount of fuel supplied at each injection stroke of the injection pump to be varied and a control valve for deriving said control pressure from the output pressure of the supply pump.

With such an apparatus a danger exists for example, if the output pressure of the supply pump should fall. In such a situation the component can move under the action of its resilient loading to effect an increase in the supply of fuel to the injection pump with the result that more fuel will be supplied by the injection pump to the associated engine even though the pressure available to fill the injection pump is reduced. This can result in an increase in the speed of the associated engine beyond its safe maximum value.

The object of the present invention is to provide an apparatus of the kind specified in a simple and convenient form.

According to the invention an apparatus of the kind specified includes a valve responsive to the pressure drop across said control valve, said valve being included in the flow path between the low pressure supply pump and the injection pump, said valve being arranged to prevent flow of fuel along said flow path in the event that the pressure drop across said control valve falls below a predetermined value.

Figure 1:
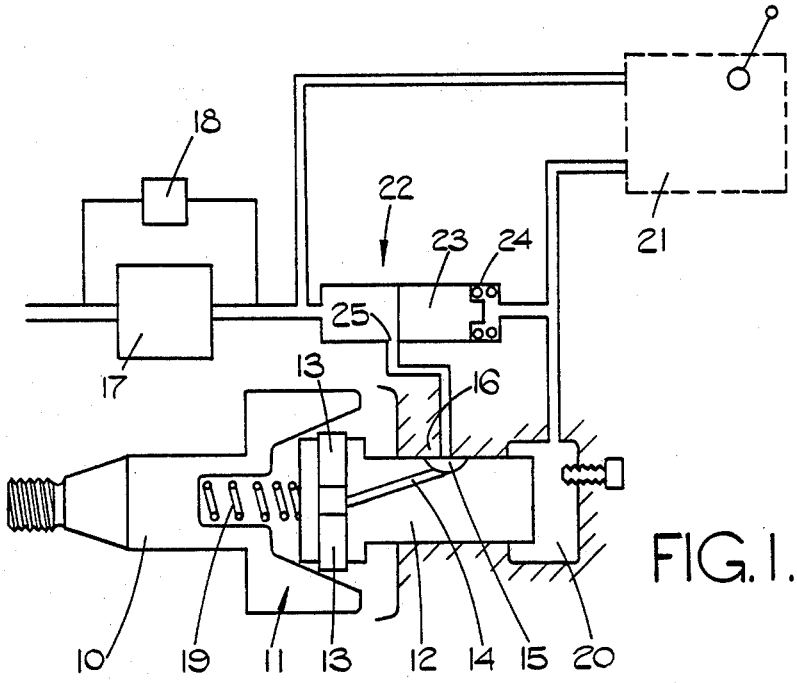
Figure 2:
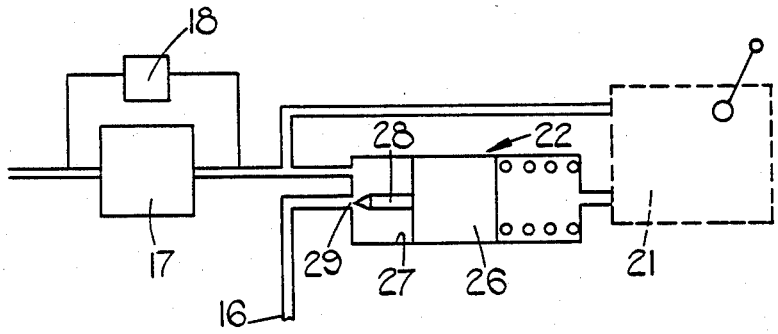

In the accompanying drawings:

FIG. 1 is a diagrammatic view of one example of and apparatus in accordance with the invention and FIG. 2 shows a modification of part of the apparatus of FIG. 1.

The mechanical construction of the apparatus is as described in British patent specification Ser. No. 2,037,365. The apparatus comprises a drive shaft 10 having an enlarged portion 11 of generally annular form. The drive shaft is driven in use in timed relationship with the associated engine and it is coupled to a distributor member 12 rotatable in a surrounding body. The distributor member mounts a pair of plungers 13 which are movable inwardly by the action of cam lobes formed on a cam ring not shown. During inward movement of the plungers fuel is displaced to an outlet. Communicating with the bore containing the plungers is a passage 14 which terminates in a slot 15 formed on the periphery of the distributor member 12. For registration with the slot there is provided a plurality of inlet ports 16 only one of which is shown. The inlet ports 16 communicate with the outlet of a low pressure supply pump 17 with which is associated a valve 18 which controls the output pressure so that it varies in accordance with the speed at which the drive shaft is rotated. Conveniently the rotary part of the low pressure pump is driven by the input shaft 10.

The distributor member 12 is biassed relative to the drive shaft by means of a spring 19 and the extent of outward movement of the plungers is determined by the relative axial position of the distributor member and drive shaft. For this purpose the internal surface of the enlarged portion of the drive shaft is tapered and followers associated with the plungers 13 respectively but not shown in the drawing, have complementary surfaces for engagement with the tapered internal surface. As the distributor member moves under the action of the spring 19 the permitted outward movement of the plungers while the fuel is being supplied to the bore containing the plungers is increased. Hence more fuel will be supplied to the engine.

The end of the distributor member constitutes a surface exposed to the pressure within a chamber 20 and as the pressure within the chamber 20 is increased, the distributor member is moved against the action of the spring 19. The pressure within the chamber is determined by the control valve indicated at 21 and the source of pressure is the outlet pressure of the supply pump 17. The control system may be electronic in nature and in use, a pressure drop occurs across the control valve 21. This pressure drop increases as the control valve is moved to reduce the control pressure applied to the distributor member.

In the event that the outlet pressure of the pump 17 falls for example, due to fuel starvation, then while initially the control valve 21 will effect correction so that the axial setting of the distributor member is not altered, a value of pressure will be reached at which the control valve can no longer control the pressure in the chamber 20. The distributor member 12 will therefore move under the action of the spring 19 to the maximum fuel position. Even though the outlet pressure of the pump 17 has fallen to a low value, sufficient pressure will be available to move the plungers outwardly and as a result there will be a increase in the flow of fuel to the engine and the engine speed could exceed its maximum safe value.

In order to effect a control over the engine speed a valve 22 is provided and this comprises a valve member 23 slidable within a cylinder. One end of this cylinder is connected to the outlet of the supply pump while the other end of the cylinder is connected downstream of the control valve 21. Within the cylinder is located a slidable valve member 23 which is biassed by a spring 24 towards the aforesaid one end of the cylinder. Formed in the wall of the cylinder is a port 25 which communicates with the inlet port 16.

In operation, the valve member 23 is responsive to the pressure drop across the control valve 21 and in normal operation, the valve member 23 is maintained at a position to uncover the port 25. In this position the spring 24 is compressed. In the event however that the pressure drop across the control valve falls below a predetermined value, as when the outlet pressure of the low pressure pump 17 falls, the valve member 23 will move under the action of the spring 24 to cover the port 25 and hence prevent the supply of fuel along the flow path between the low pressure supply pump and the injection pump constituted by the plungers 13.

The pressure drop across the control valve 21 is at minimum when the control valve is set to supply the minimum amount of fuel to the engine. The pressure drop increases as the control valve is moved to increase the supply of fuel to the engine. The spring 24 must therefore exert a force upon the valve member such that in normal operation, the valve member will not close the port when the control valve is set to the minimum fuel position.

With this arrangement when the engine is at rest, the valve member 23 will cover the port 25 and therefore when starting the engine, no fuel will be supplied to the engine until the low pressure pump has developed sufficient pressure to move the valve member 23 against the action of the spring 24 to uncover the port 25.

An alternative form of the valve 22 is seen in FIG. 2. In this arrangement the valve member is in the form of a piston 26 slidable within a cylinder 27 one end of which is connected to the chamber 20 and the other end of which is connected to the outlet of the low pressure pump 17. A coiled compression spring 28 biases the piston towards the end of the cylinder which communicates with the pump and the adjacent end of the piston mounts an extension 28 which is shaped to co-operate with a part 29 located in the adjacent end wall of the cylinder and which communicates with the inlet ports 16. The mode of operation of the valve is exactly the same as the valve shown in FIG. 1.

I claim:

1. A liquid fuel injection pumping apparatus for supplying fuel to an internal combustion engine comprising an injection pump operable in use to deliver fuel in timed relationship with an associated engine, a low pressure supply pump for supplying fuel to the injection pump, valve means for controlling the output pressure of the supply pump, a resiliently loaded component defining a surface against which a control pressure can act to enable the amount of fuel supplied at each injection stroke of the injection pump to be varied, a control valve for deriving said control pressure from the output pressure of the supply pump, and a valve responsive to the pressure drop across said control valve, said valve being included in the flow path between the low pressure supply pump and the injection pump, said valve being arranged to prevent flow of fuel along said flow path in the event that the pressure drop across said control valve falls below a predetermined value.

2. An apparatus according to claim 1 in which said valve comprises a cylinder and a valve member slidable within the cylinder, the opposite ends of the cylinder being connected to the outlet of said supply pump and a chamber in which said surface is located, resilient means biasing the valve member towards the end of the cylinder which communicates with the outlet of the supply pump, and a port in a wall of said cylinder, said port being opened to said one end of the cylinder when said pressure drop exceeds said predetermined value, said port being connected to said injection pump.

3. An apparatus according to claim 2 in which said port is formed in the side wall of the cylinder and is adapted to be covered by the valve member when the pressure drop falls below the predeterminec value.

4. An apparatus according to claim 2 in which said port is formed in an end wall of the cylinder and said valve member is in the form of a piston having an extension for co-operation with said port when the pressure drop falls below the predetermined value.

* * * * *